US009657485B2

(12) United States Patent
Meyers

(10) Patent No.: US 9,657,485 B2
(45) Date of Patent: May 23, 2017

(54) TILE LEVELING SYSTEM

(71) Applicant: Lawrence G. Meyers, Layton, UT (US)

(72) Inventor: Lawrence G. Meyers, Layton, UT (US)

( * ) Notice: Subject to any disclaimer, the term of this patent is extended or adjusted under 35 U.S.C. 154(b) by 0 days.

(21) Appl. No.: 15/167,469

(22) Filed: May 27, 2016

(65) Prior Publication Data

US 2016/0348381 A1 Dec. 1, 2016

Related U.S. Application Data

(60) Provisional application No. 62/168,064, filed on May 29, 2015.

(51) Int. Cl.

| | |
|---|---|
| ***E04F 21/18*** | (2006.01) |
| ***E04F 21/22*** | (2006.01) |
| ***E04F 15/02*** | (2006.01) |
| ***E04F 13/08*** | (2006.01) |
| ***E04F 21/00*** | (2006.01) |

(52) U.S. Cl.

CPC ..... *E04F 21/1877* (2013.01); *E04F 13/0892* (2013.01); *E04F 15/02022* (2013.01); *E04F 21/0092* (2013.01); *E04F 21/22* (2013.01)

(58) Field of Classification Search

CPC ... E04F 21/0092; E04F 21/22; E04F 13/0892; E04F 15/02022; E04F 21/1877

See application file for complete search history.

(56) References Cited

U.S. PATENT DOCUMENTS

| | | | | |
|---|---|---|---|---|
| 136,428 A * | 3/1873 | Foster | ..... | E04F 21/22 254/12 |
| 475,855 A * | 5/1892 | Graham | ..... | E04F 21/22 254/12 |
| 597,671 A * | 1/1898 | Dutt | ..... | E04F 21/22 254/12 |
| 719,335 A * | 1/1903 | Hoekstra | ..... | E04F 21/22 254/12 |

(Continued)

FOREIGN PATENT DOCUMENTS

| | | |
|---|---|---|
| CH | 591613 A5 | 9/1977 |
| CN | 103362295 A | 10/2013 |

(Continued)

OTHER PUBLICATIONS

International Search Report from corresponding PCT Application No. PCT/US2016/034944, Sep. 30, 2016.

*Primary Examiner* — Charles A Fox
*Assistant Examiner* — Charissa Ahmad
(74) *Attorney, Agent, or Firm* — Workman Nydgegger

(57) ABSTRACT

A tile leveling system includes an anchor member arranged to be positioned in a setting bed below adjacent tiles. A tensioning member extends upwardly from the anchor member and is arranged to pass between the adjacent tiles. The tensioning member is made of a metallic material and frangibly connected to the anchor member via a breakage point. A loading system is arranged to be positioned on top of the adjacent tiles and includes a drive mechanism. The drive mechanism is connected to the tensioning member and (Continued)

is selectively operable to secure and level the adjacent tiles between the anchor member and the loading system.

19 Claims, 6 Drawing Sheets

(56) References Cited

U.S. PATENT DOCUMENTS

| | | | | |
|---|---|---|---|---|
| 3,582,857 | A * | 6/1971 | Kishel | H01C 10/14 338/174 |
| 3,924,308 | A * | 12/1975 | Duprez | F16L 33/08 24/274 R |
| 4,397,125 | A | 8/1983 | Gussler, Jr. | |
| 4,445,254 | A * | 5/1984 | Allert | F16L 33/08 24/274 R |
| 5,257,439 | A * | 11/1993 | LeBlanc | A61C 7/18 24/269 |
| 5,410,781 | A * | 5/1995 | Anjos | F16L 33/08 24/274 R |
| 5,675,942 | A | 10/1997 | Crawford | |
| 7,001,126 | B2 * | 2/2006 | Lesecq | F16B 19/1054 411/340 |
| 7,451,671 | B2 * | 11/2008 | Coleman, Jr. | E04F 21/22 254/12 |
| 7,621,100 | B2 * | 11/2009 | Kufner | E04F 13/0892 33/526 |
| 7,765,650 | B2 * | 8/2010 | Bowater | F16L 33/08 24/20 R |
| 7,861,487 | B2 | 1/2011 | Kufner et al. | |
| 7,954,300 | B1 * | 6/2011 | Kufner | E04F 21/22 33/526 |
| 7,992,354 | B2 * | 8/2011 | Doda, Jr. | E04F 13/0892 52/127.7 |
| 8,079,199 | B1 * | 12/2011 | Kufner | E04F 13/0892 33/526 |
| 8,181,420 | B2 | 5/2012 | Torrents I Comas | |
| 8,429,878 | B1 | 4/2013 | Hoffman et al. | |
| 8,429,879 | B1 * | 4/2013 | Hoffman | E04F 21/0092 52/747.11 |
| 8,434,738 | B1 * | 5/2013 | Anstett | E04F 21/22 254/11 |
| 8,607,530 | B2 * | 12/2013 | Hoffman | E04F 21/00 52/747.11 |
| 8,635,747 | B2 * | 1/2014 | Felber | F16L 33/035 24/274 R |
| 8,635,815 | B2 | 1/2014 | Bordin | |
| 8,661,639 | B2 * | 3/2014 | Bondielli | E04F 21/0092 29/243.5 |
| 8,820,031 | B2 | 9/2014 | Kufner et al. | |
| 9,045,911 | B2 * | 6/2015 | Hoffman | E04F 21/0092 |
| 9,228,363 | B2 * | 1/2016 | Kufner | E04F 21/0092 |
| 9,260,872 | B2 * | 2/2016 | Bunch | E04F 21/0092 |
| 9,267,297 | B2 * | 2/2016 | Zinssler | E04F 13/0803 |
| 9,328,522 | B2 * | 5/2016 | Bordin | E04F 21/20 |
| 9,562,365 | B2 * | 2/2017 | Bucsa | E04F 21/0092 |
| 2005/0028329 | A1 * | 2/2005 | Castellanos | F16L 33/08 24/274 R |
| 2012/0227223 | A1 * | 9/2012 | Knox | B60P 7/083 24/68 CD |
| 2014/0033641 | A1 * | 2/2014 | Trevisi | E04F 21/0092 52/749.1 |
| 2015/0113895 | A1 | 4/2015 | Zinssler | |

FOREIGN PATENT DOCUMENTS

| | | | |
|---|---|---|---|
| DE | 202014100068 | U1 | 6/2014 |
| EP | 2514886 | A1 * | 10/2012 |
| EP | 2549030 | A2 * | 1/2013 |
| EP | 2775068 | A1 | 9/2014 |
| JP | H07305494 | A | 11/1995 |
| WO | 2013/023236 | A1 | 2/2013 |
| WO | 2014/022889 | A1 | 2/2014 |

* cited by examiner

TILE LEVELING SYSTEM

TECHNICAL FIELD

The disclosure relates to a system for leveling adjacent tiles as they are laid in floors, walls, countertops, and the like.

BACKGROUND

Tile has become a popular choice for use in floors, walls, countertops, and the like. Both professional tile installers and do-it-yourselfers spend a great deal of time aligning and leveling tiles as the tiles are being placed on a substrate's surface. Proper alignment and leveling of each tile is important for a number of reasons. One reason is that if one tile is improperly placed, the error will continue in adjacent tiles such that the installation will be unacceptable and the tiles will have to be replaced and/or ground and polished until the tiles are level or flat. In addition to aesthetic reasons, a level surface is important in tile floors so that people do not trip and fall on unevenly laid tiles. Replacing or otherwise correcting errors in tile installation takes time that adds to the total cost of the installation.

Laying and leveling tile can also be problematic because tiles can shift and sink into mortar as the mortar dries, making it necessary to continually monitor newly laid tiles as the mortar dries to ensure that the tiles remain level. This can be very time consuming and frustrating for an installer. Tile installers have used a variety of devices and methods to maintain quality tile installation while completing the installation process. However, conventional devices and techniques are labor intensive, expensive, time consuming, complicated, and do not always work properly.

There is thus a need for a method and system for leveling tiles that is versatile, reusable, reliable, and fast.

SUMMARY

Embodiments of the tile leveling system are versatile, reusable, reliable, and fast. According to an embodiment, the tile leveling system includes an anchor member arranged to be positioned in a setting bed below adjacent tiles. A tensioning member extends upwardly from the anchor member and is arranged to pass between the adjacent tiles. The tensioning member is made of a metallic material and frangibly connected to the anchor member via a breakage point. A loading system is arranged to be positioned on top of the adjacent tiles and includes a drive mechanism. The drive mechanism is connected to the tensioning member and is selectively operable to secure and level the adjacent tiles between the anchor member and the loading system.

According to a variation, rotation of the drive mechanism tensions the tensioning member to level and align the adjacent tiles and also to separate the tensioning member from the anchor member after curing. Because the tensioning member includes a metallic material which is generally at least as hard as the tiles, the tensioning member can better resist deformation or maintain its shape between the tiles. This is advantageous because conventional tensioning members are typically softer than the tiles (e.g. ceramic, porcelain, stone). As such, they tend to deform between the tiles, which, in turn, can cause them to break at irregular locations. Moreover, if the sides of the tiles have any irregularities or hardened setting bed material has penetrated the joint between the tiles, the irregularities or hardened material can gouge and/or weaken known tensioning members, increasing the likelihood of an unclean break.

According to a variation, the system is able to level and secure tiles for curing without having to rotate any parts on the top surface of the tiles. This is advantageous because rotation of parts on the top of the tiles may in some instances entrap debris including sand, which has the potential to scratch the tiles, especially softer marble tiles with highly polished surfaces.

According to a variation, the system can be re-used in dozens, hundreds, or any other suitable number of jobs. The system also does not require proprietary tools to the loading system and tensioning member from a cured tile project, making the system faster, more affordable, and easier to use.

BRIEF DESCRIPTION OF THE DRAWINGS

These and other features, aspects, and advantages of the present disclosure will become better understood regarding the following description, appended claims, and accompanying drawings.

DETAILED DESCRIPTION OF VARIOUS EMBODIMENTS

Figure 2A:
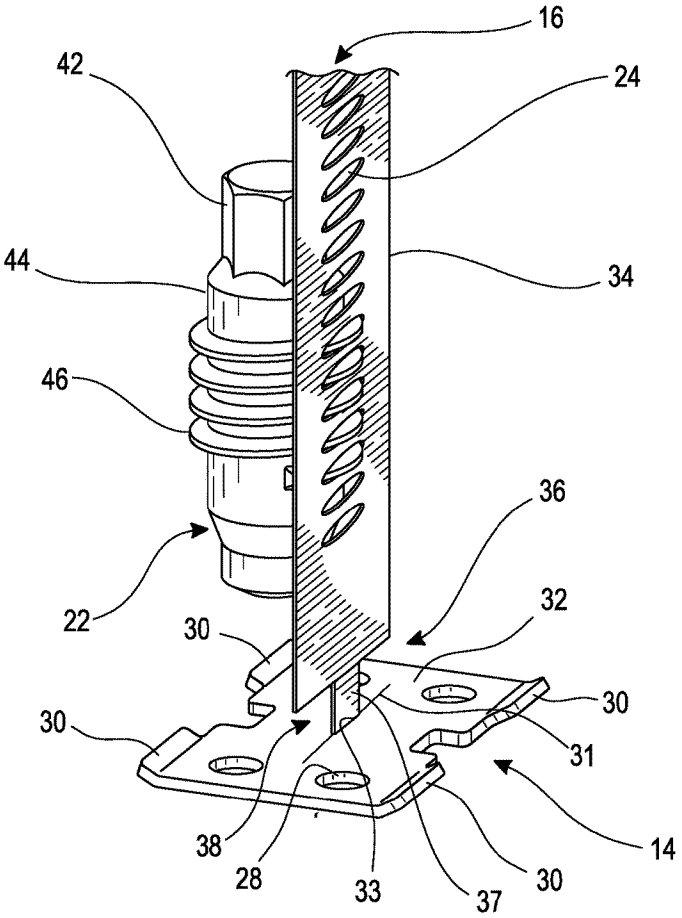
FIG. 2A is an isometric view of the tensioning member, anchor, and drive screw removed from the tile leveling system shown in FIG. 1 for ease of reference.

A better understanding of different embodiments of the disclosure may be had from the following description read with the accompanying drawings in which like reference characters refer to like elements.

While the disclosure is susceptible to various modifications and alternative constructions, certain illustrative embodiments are in the drawings and described below. It should be understood, however, there is no intention to limit the disclosure to the embodiments disclosed, but on the contrary, that the intention covers all modifications, alternative constructions, combinations, and equivalents falling with the spirit and scope of the disclosure.

For further ease of understanding the embodiments of an orthopedic device as disclosed herein, a description of a few terms is necessary. As used herein, the term "tile" has its ordinary meaning but should also be understood to include panels, sheets, boards, paving stones, bricks, and/or other suitable coverings. Likewise, the term "substrate" has its ordinary meaning and can include floors, walls, countertops, or the like.

The terms "rigid," "flexible," and "resilient" may be used herein to distinguish characteristics of portions of certain features of the leveling system. The term "rigid" is intended to denote that an element of the device is generally devoid of flexibility. Within the context of base plates that are "rigid," it is intended to indicate that they do not lose their overall shape when force is applied, and that in fact they may break if bent with sufficient force. On the other hand, the term "flexible" is intended to denote that features are capable of repeated bending such that the features may be bent into retained shapes or the features do not retain a general shape, but continuously deform when force is applied. The term "resilient" is used to qualify such flexible features as generally returning to an initial general shape without permanent deformation. As for the term "semi-rigid," this term is used to connote properties of housing bodies that provide support and are free-standing; however, such housing bodies may have some degree of flexibility or resiliency.

FIGS. 1-5 show an exemplary embodiment of a tile leveling system 10 including a loading system 12, an anchor member 14 (shown in FIG. 2A), and a tensioning member 16 extending upwardly from the anchor member 14 and operatively connected to the loading system 12. The loading system 12 can include a housing body 18, a base plate 20 (shown in FIG. 3), and a drive mechanism 22 supported on the base plate 20 and arranged to interact with slots 24 defined in the tensioning member 16.

Laying tiles typically includes applying a setting bed such as mortar or cement to a substrate surface (e.g., floor, wall, counter top). After the setting bed material is applied, tiles 26 are placed in the setting bed. Generally, use of the system 10 includes positioning the anchor member 14 in the setting bed beneath the tiles 26 so that the tensioning member 16 extends upwardly between adjacent tiles 26. It will be appreciated that this can be done in any suitable manner. For instance, a first side of the anchor member 14 can be positioned under a first tile 26 and then a second tile 26 can be placed over a second side of the anchor member 14 opposite the first side.

Figure 1:
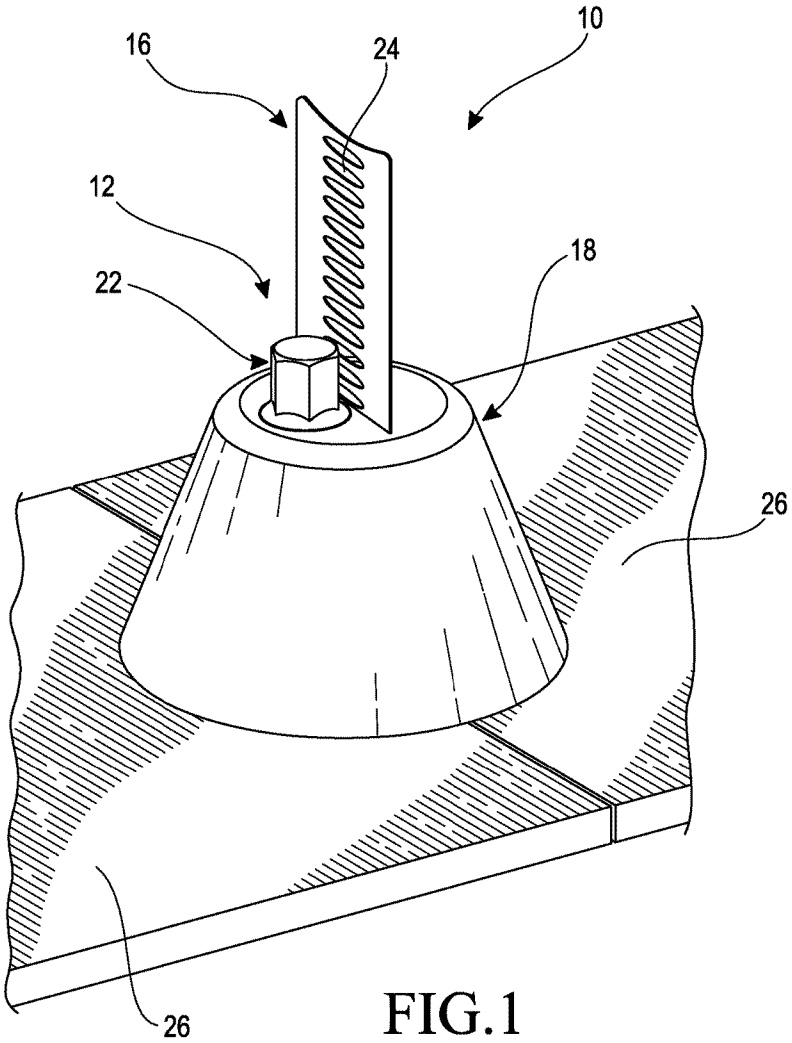
FIG. 1 is an isometric view of a tile leveling system according to an embodiment.

The tensioning member 16 extends from the anchor member 14 upwardly between the tiles 26 and is operatively connected to the loading system 12, which is positioned above the tiles 26 as seen in FIG. 1. Operation of the loading system 12 can move the anchor member 14 and the loading system 12 together until the tiles 26 are interlocked between the loading system 12 and the anchor member 14. By selectively rotating the drive mechanism 22, the loading system 12 and the anchor member 14 can level and align the tiles 26, reducing the likelihood of lippage (which is a variation in the height of the edges between adjacent tiles 26). This is advantageous because lippage can create a variety of problems, such as a potential trip hazard and ruining the look of a tile installation job. It also eliminates the need to re-lift tiles to add more setting bed material and/or the process of shimming tiles, which, in turn, greatly increases the speed of installation. In addition, it should be appreciated that the drive mechanism 22 is rotated relative to a housing body and base plate described below. The housing body and the base plate are not required to be rotated on the top surface of the tiles 26 to actuate the system 10 as in the prior art. This is advantageous because rotation of the housing body and/or the base plate on the top surface of the tiles 26 may in some instances entrap debris including sand from the setting bed, which has the potential to scratch the tiles 26, especially softer marble tiles with highly polished surfaces.

Once the tiles 26 are properly positioned, the system 10 is left in place until the setting bed dries or cures, securing the tiles 26 to the substrate surface. This advantageously eliminates the need for the installer to continually monitor and go back and adjust the tiles due to settling as the setting bed cures.

After the setting bed is cured, the installer can remove the portion of the system 10 that is visible above the laid tiles 26 (e.g., the loading system 12 and the tensioning member 16). The loading system 10 can then be removed from the tensioning member 16 and re-used in subsequent tile laying jobs. In an embodiment, the tensioning member 16 can be simply pulled up and out of the loading system 12. This is beneficial because many leveling devices require manual untwisting for disassembly, which can be both fatiguing and daunting on installation jobs involving hundreds of leveling devices.

The loading system 12 can thus be re-used in dozens, hundreds, or any other suitable number of jobs. The system 10 also advantageously does not require proprietary or specific tools to remove the loading system 12 and tensioning member 16 from the cured floor or other tile project, making it more affordable and easy to use.

FIG. 2A shows the anchor member 14, tensioning member 16, and drive mechanism 22 removed from the system for ease of reference. The anchor member 14 can have any suitable shape but is shown having a generally rectangular shape. The anchor member 14 is arranged to be positioned under adjacent tiles 26 in the setting bed to hold or position the upper surface of each tile at substantially the same height. More particularly, the anchor member 14 is positioned in the setting bed beneath the tiles 26 so that the tensioning member 16 extends from the anchor member 14 upwardly between the adjacent tiles 26, preferably at a joint or corner locations. From the tensioning member 16, the anchor member 14 extends radially outward underneath the adjacent tiles. It will be appreciated that the anchor member 14 can be positioned under two, three, four, or any other suitable number of tiles.

As seen in FIG. 2A, one or more through apertures 28 can be defined in the anchor member 14. The apertures 28 can allow the setting bed material to seep through the anchor member 14. This seepage allows the setting bed material to bond with a portion of the tiles 26 directly above the anchor member 14, which otherwise may not contact much of the setting bed material. Further, the seepage helps maintain the tiles 26 level as forces are applied to the anchor member 14, setting bed material, and/or tiles 26 during tightening leveling, and setting. If the setting bed material was not allowed to seep through the anchor member 14, the setting bed material could raise the anchor member 14 as it dried, which could consequently affect the level of the tiles 26. It will be appreciated that the anchor member 14 can define one, two, five, ten, and/or any other suitable number of apertures 28. Further, the apertures 28 can comprise circular openings, rectangular openings, slots, combinations thereof, or any other suitable type of opening.

The anchor member 14 can also include a plurality of corner portions 30. The corner portions 30 can have a curved configuration. The corner portions 30 can be curved upwardly from a main body portion 32 of the anchor member 14 such that when the corner portions 30 are engaged with the tiles 26 a clearance is formed or maintained between the bottom surface of the tiles 26 and the main body portion 32 of the anchor member 14. This clearance helps the setting material to move or pass in between the tiles 26 and the anchor member 14, which, in turn, helps to maintain the tiles level. The anchor member 14 can be made from any suitable material; however, it is preferably comprised of a metallic material, providing strength and rigidity to the anchor member 14 that may be needed for leveling and/or setting heavier tiles.

Figure 7:
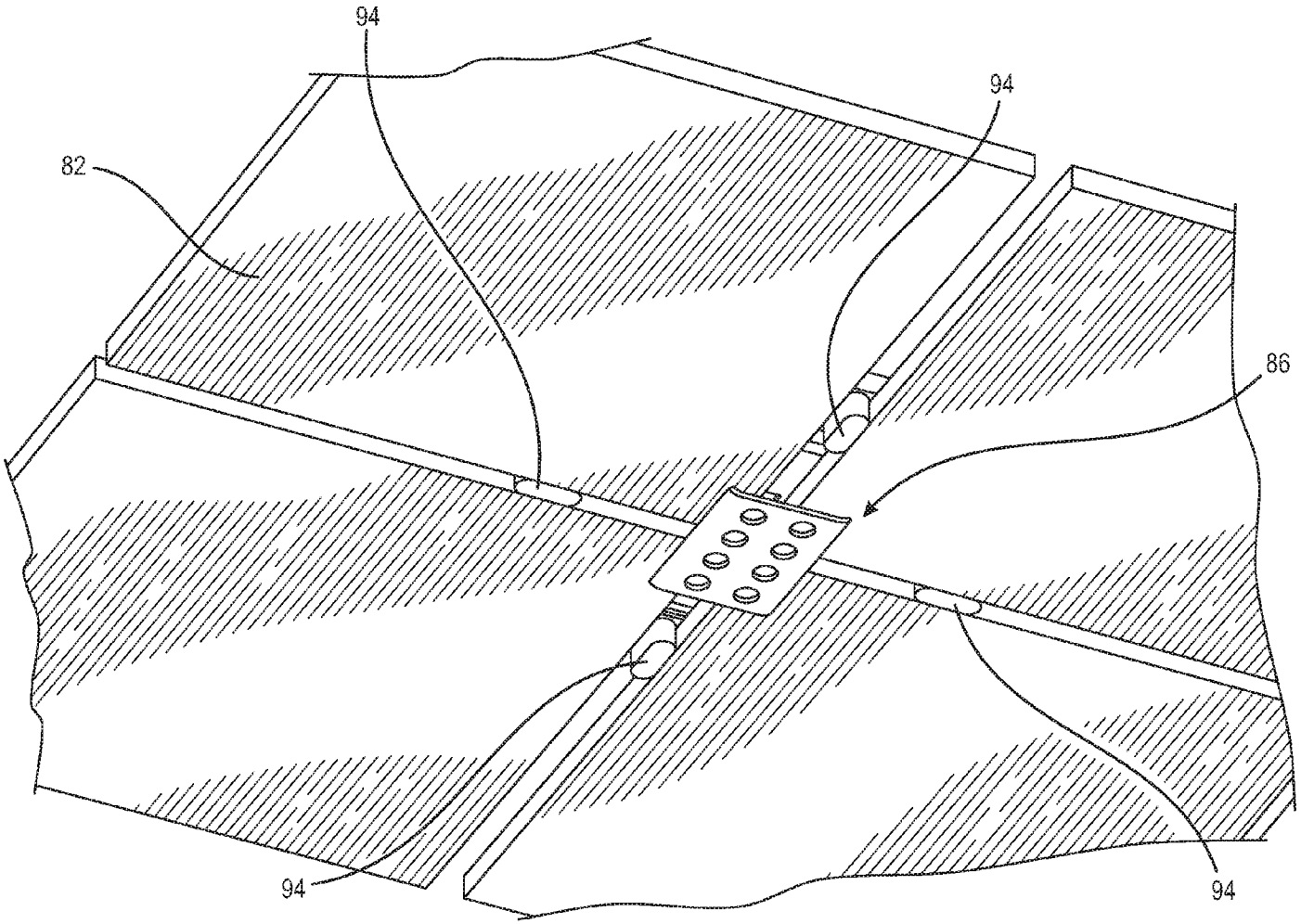
FIG. 7 is a bottom isometric view of the tile leveling system shown in FIG. 6.

According to a variation, the anchor member 14 can include four raised corner portion 30, each having a resilient configuration arranged to impart or apply a biasing pressure to the bottom surface of an individual tile at a four tile intersection (best seen in FIG. 7). For instance, each corner portion 30 can be curled up so that when loaded against the bottom surface of a respective one of the tiles it acts like a spring, applying pressure to the bottom surface of the tile toward the base plate regardless of the thickness and/or profile of the tile. This advantageously can provide sufficient pressure from below to raise all four tiles into alignment with the bottom surface of the base plate 20. Alternatively, the anchor member 14 can include resilient raised corner portions for use at the intersection of two, three, or any other suitable number of tiles. In other embodiments, side portions of the anchor member 14 can include resilient features.

In an embodiment, each corner portion 30 can independently impart a pressure to the bottom surfaces of the tiles 26. For instance, when the anchor member 14 is positioned under a four tile intersection (best seen in FIG. 7), each corner portion 30 can deform or flex independently when it is forced against the bottom surface of an individual tile 26 at the intersection. Stored energy in each corner portion 30 can then substantially independently impart pressure to the bottom surface of the respective tile 26. This is advantageous because if two or more of the tiles 26 at the intersection have different thicknesses, the corner portions 30 can independently bias or force the tiles 26 upward into contact with a bottom surface of the housing body 18 and/or the base plate 20, leveling the upper surfaces of the tiles 26 against the bottom surface the housing body 18 and/or the base plate 20. In an embodiment, each corner portion 30 can impart substantially a same pressure on the bottom surface of the tiles 26. The anchor member 14 can be formed of a spring material, a hardened spring material, or any other suitable material.

In an embodiment, the main body portion 32 can define an elongate slot 31. The elongate slot 31 can be arranged to enhance the flexibility or resiliency of the anchor member 14 and/or help attach the tensioning member 16 to the anchor member 14. In an embodiment, the tensioning member 16 can be generally aligned with the elongated slot 31. In other embodiments, the tensioning member 16 can be generally parallel and offset a distance from the elongated slot 31. In yet other embodiments, the tensioning member 16 can transverse the elongated slot 31.

The tensioning member 16 extends upwardly from the anchor member 14 and is arranged to extend between at least two adjacent tiles 26. In an embodiment, the tensioning member 16 can comprises a strap 34 having an elongate configuration. The strap 34 can be attached to the anchor member 14 in any suitable manner. For instance, the elongate slot 31 of the anchor member 14 can receive a distal end of the strap 34. The anchor member 14 can then be pressed or pinched to cause the slot to close on the distal end of the strap 34, forming a mechanical lock between the anchor member 14 and the strap 34. In other embodiments, the strap 34 can be welded to the anchor member 14. The strap 34 can be flexible or semi-flexible. In other embodiments, the strap 34 can be substantially rigid.

The strap 34 can be made from any suitable material; however, it is preferably comprised of a metallic material, improving the tensile strength of the strap 34 and increasing the likelihood of a clean break from the anchor member 14 as discussed below. For instance, plastic strap members found in conventional leveling systems typically include internal stresses and/or imperfections, which, in turn, can cause the straps to break under tension at undesirable locations and/or in irregular shapes above the top of the tiles. This can be especially problematic if the tiles are already set in the setting material because the tiles have to be pulled up to remove the unsightly and potentially danger strap remnant and then the tiles must be laid down again, making the tile job more labor intensive, time consuming, and very expensive.

The strap 34 can have a relatively thin configuration. For example, the strap 34 can have a thickness of less than about 0.012, about 0.010, about 0.08 inches, about 0.06 inches, about 0.05 inches, or about 0.04 inches. This is advantageous because if desired the system 10 can be used to install tiles without grout joints. For instance, installers who are setting stone tiles (e.g., marble, tavertine) often desire to have the stone tiles butt tight together with no grout joints so that the top surfaces can be honed and polished after installation to create the installation of a seamless stone surface. Because of the thinness of the strap 34, it can be used to leave a gap between adjacent ones of the stone tiles that is so thin as to not be easily visible. The system 10 is thus a significant improvement over prior art systems that include straps that are significantly thicker (e.g., 0.02 inches thick), leaving gaps between the stone tiles that are too wide and undesirably visible, making it impossible to install a seamless stone surface.

The strap 34 can include a stainless metallic material, helping to prevent oxidation, which, in turn, reduces the likelihood of the strap 34 rusting and staining the tiles 26. For instance, the strap 34 can be formed of a full hard 300 series stainless steel material having a tensile strength of greater than about 200 KSI and a surface hardness of about Rc40. The combination of the thinness of the strap 34 and increased tensile strength can allow the strap 34 to be used for different applications. For instance, the strap 34 may be used for granite slab counter top vertical seam alignment in a manner similar to the tile alignment, making the system 10 advantageously a multi-use device.

In other embodiments, the strap 34 can include a wrought or rolled metallic material. The strap 34 can include steel, aluminum, copper, tin, or any other suitable metal. Further, the strap 34 can be compressed and/or pinched between the tiles 26 during installation. Because the strap 34 includes a metallic material that is generally at least as hard as the tiles 26, the tensioning member 16 can resist deformation or maintain its shape between the tiles. This is advantageous because conventional plastic straps are softer than the tiles (e.g. ceramic, porcelain, stone). As such, they tend to deform between the tiles, which, in turn, can cause the strap to break at irregular locations. Moreover, if the sides of the tiles have any irregularities or hardened setting bed material has penetrated the joint between the tiles, the irregularities or hardened material can gouge and/or weaken the plastic strap, increasing the likelihood of an unclean break.

As seen, the strap 34 defines a plurality of slots 24 distributed in an array along a length of the strap 34. The slots 24 can exhibit any suitable shape but are shown being elongated oval and can be generally horizontal or angled relative to horizontal. As described in more detail below, the slots 24 are arranged to interact with threads on the drive mechanism 22 such that the drive mechanism 22 can move the tensioning member 16 up and down relative to the drive mechanism 22.

In an embodiment, the strap 34 can be frangibly or separately connected to the anchor member 14. For instance, a distal portion of the strap 34 can include a breakage point 36 at or near the connection of the strap 34 to the anchor member 14. The breakage point 36 is arranged for selectively separating the strap 34 from the anchor member 14 upon the application of a target or specific tension to the strap 34. In an embodiment, the breakage point 36 is weaker than the remainder of the strap 34 so that the installer can apply a force to the portion of the strap 34 that extends above the tiles 26, which, in turn, causes the strap 34 to break and separate at its breakage point 36. In an embodiment, the drive mechanism 22 can be rotated to tension the strap 34 to a breaking tension at which the strap 34 breaks and separates at its breakage point 36. It will be appreciated that the breaking tension can be selected and/or adjusted based on the application, characteristics of the tiles (e.g., weight, size, etc.), and/or other factors. The breakage point 36 is located on the strap 34 such that the anchor member 14 and any strap remnant are hidden below the top of the tiles 26 after the strap 34 breaks at the breakage point 36.

As shown in FIG. 2A, the breakage point 36 can comprise a single connecting portion 37 having a slender or thin configuration. The connecting portion 37 can extend in a generally axial direction between the strap 34 and the connection of the strap 34 to the anchor member 14. As seen, portions of the strap 34 can removed on opposing sides of the connecting portion 37 defining a pair of elongated openings 38, each extending in a transverse direction from the connecting portion 37 through a side of the strap 34. This allows the breakage point 36 to be structurally weaker and separate when the proper force is applied by the installer.

More particularly, the connecting portion 37 is sized and configured so that an applied force to the strap causes the strap 34 to break at the connecting portion 37. Because the connecting portion 37 defines the only portion of the strap 34 extending between the anchor member 14 and the strap 34 or between the strap 34 and the connection of the strap 34 to the anchor member 14, the strap 34 advantageously can break and/or separate from the anchor member 14 in a cleaner, more predictable manner. For instance, with a single point of separation on the strap 34 there is substantially no risk of the strap 34 breaking at one point and twisting or deforming about another point, resulting in irregular or inconsistent remnants of the strap 34 between different tiles 26. In addition, there is no need or constraint that the strap 34 simultaneously break at multiple points to obtain a clean break. Further, the force required to the break the strap 34 at the connection portion 37 can vary in form and/or direction without substantially affecting the quality of the break, making the system 10 more versatile and consistent. By way of example, a tensile force applied to the strap 34 and a rotational force applied to the strap 34 may break the strap 34 at the connecting portion 37 in a substantially same manner.

Figure 2B:
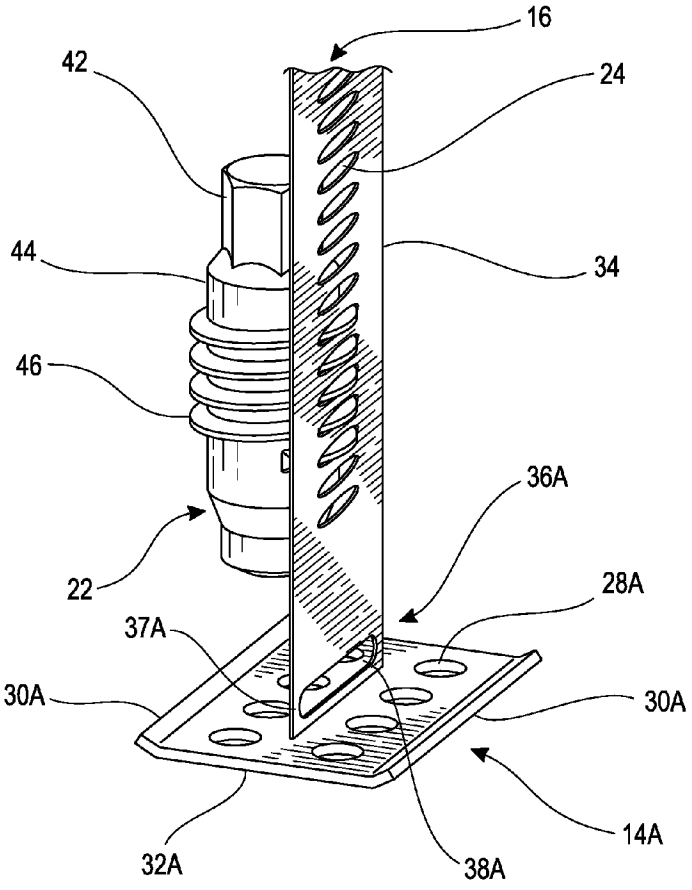
FIG. 2B is an isometric view of the tensioning member and anchor according to another embodiment.

According to a variation, the breakage point 36A can comprise a single opening 38A in between a pair of generally upright connecting portions 37A as shown in FIG. 2B. Also shown, the anchor member 14A according to a variation can be generally rectangular and can include one or more side portions 30A curving upward from a main body portion 32A such that a clearance can be formed or maintained between the bottom surface of the tiles 26 and the main body portion 32A of the anchor member 14A. Similar to the other embodiment, one or more through apertures 28A can be defined in the anchor member 14A, allowing setting bed material to seep through the anchor member 14A as discussed above.

In some embodiments, the breakage point 36 is arranged to separate when a force is applied to the strap 34 that is significantly higher than typical forces applied to the strap 34 during tile placement. As discussed above, the strap 34 is preferably made of a metallic material, allowing it to more predictably break at the breakage point 36 as opposed to other locations as in the prior art. In other embodiments, the breakage point 36 comprises a plurality of slots, holes, or cutouts which allows the breakage point 36 to be structurally weaker and separate when the proper force is applied by the installer after breakage is hidden below the top surface of the tiles 26.

According to a variation, the breakage point 36 or connection between the anchor member 14 and the strap 34 can define a hinge or pivot point about which the anchor member 14 can pivot and the anchor member 14 can define a rocker-type bottom. As such, if the bottom surfaces of adjacent tiles 26 are uneven or at different heights, the anchor member 14 can rock or pivot about the connection or breakage point 36 so that the opposing side portions 30 of the anchor member 14 engage both bottom surfaces of the tiles 26 at the different heights. This advantageously allows the anchor member 14 to raise both tiles into alignment with the bottom of a base plate described below.

Referring still to FIG. 2, the drive mechanism 22 can comprise any suitable mechanism but is shown as a screw or worm. The drive mechanism 22 can include a cylindrical body having a head portion 42 and a shaft portion 44. The drive mechanism 22 is positioned in a cavity defined by the housing body 18 described below. The head portion 42 can include a hex head for manually operating the drive mechanism 22. Any appropriate operator, such as a socket wrench, an adjustable wrench, a crank handle, a hand, or the like can be used to engage the hex head and to manually operate the drive mechanism 22.

At least a portion of the shaft portion 44 includes helical threads 46 arranged to intermesh or interact with the slots 24 defined in the strap 34. More particularly, the strap 34 can be attached to the drive mechanism 22 via the helical threads 46 and adapted to ride up and down on the threads 46 when the drive mechanism 22 rotates. As seen, the threads 46 can be engaged with multiple slots 24 on the strap 34 simultaneously or at the same time, better distributing the load transferred from the drive mechanism 22 on to the strap 24. This is beneficial because if the transferred load is too concentrated or localized it can cause premature failure of the strap 34 between the slots 24 before the desired break occurs at the breakage point described below.

The drive mechanism 22 can have a greater hardness than the strap 34. This is advantageous because if the strap 34 is harder than the drive mechanism 22, the threads 46 of the drive mechanism 22 may be shaved by cutting action of the strap 34, reducing its operational life. According to a variation, the drive mechanism 22 can include a lubricant for reducing friction between the drive mechanism 22 and other components of the system 10. For instance, the drive mechanism 22 can be a hardened screw drive with a high load bearing dry film lubricant applied to one or more areas, reducing friction and reducing the likelihood of shaving action. This also helps the drive mechanism 22 rotate in its place within the housing body 18 without sufficient friction to cause the housing body 18 to rotate or the tile spacing to be unintentionally widened with such action.

The pitch of the threads 46 can be selected to control the distance the strap 34 and the anchor member 14 move up and/or down upon a complete rotation of the drive mechanism 22. This allows an installer to precisely control movement of the anchor member 14, which, in turn, allows the installer to precisely control the position of the tiles 26 between the anchor member 14 and the base plate 20. In other embodiments, the threads 46 can have a varying pitch such that more or less rotation is required to achieve the target tension after the tiles 26 are set in the setting bed.

Rotation of the drive mechanism 22 can causes the strap 34 to ride up and down on the threads 46, which, in turn, moves the anchor member 14 up and down relative to the bottom of the tiles 26. When the anchor member 14 is engaged with the bottom of the tiles and the base plate 20 is engaged with the top of the tiles 26, rotation of the drive mechanism 22 in a first direction can drive the anchor member 14 and the drive mechanism 22 toward one another in the axial direction, tensioning the strap 34. This can cause the distal end of the drive mechanism 22 to exert a compressive force on the base plate 20, which, in turn, can exert a compressive force on the top of the tiles 26. The base plate 20 can thus distribute force from the drive mechanism 22 onto the tiles 26, securing the tiles between the base plate 20 and the anchor member 14. As seen, the base plate 20 can define a larger contact surface between the tiles 26 and the system 10, facilitating force distribution and/or leveling.

Figure 3:
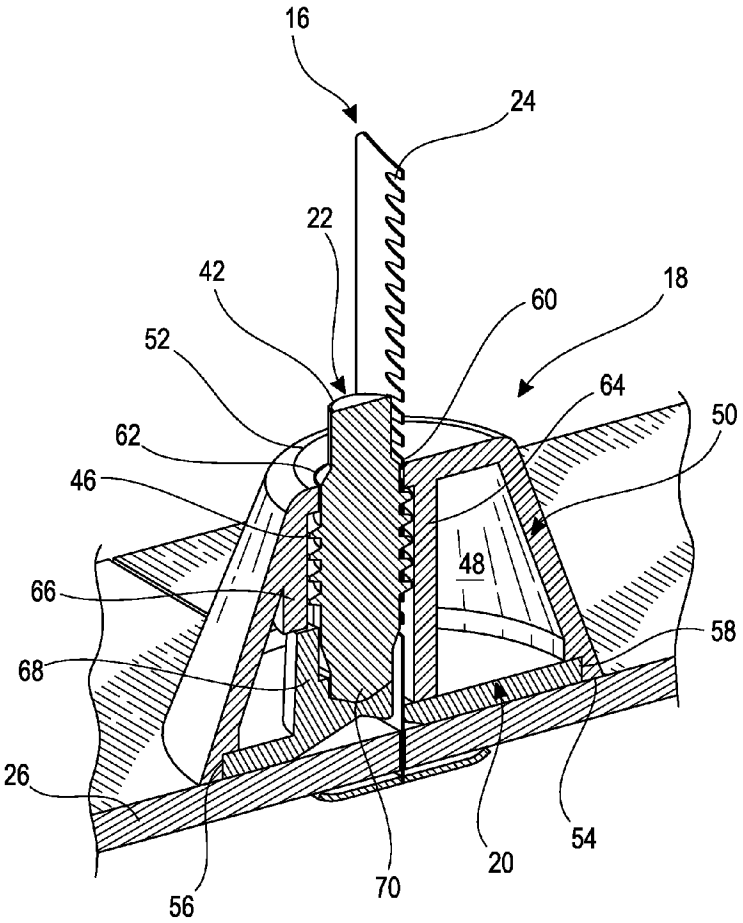
FIG. 3 is a cross section view of the tile leveling system shown in FIG. 1.

As seen in FIG. 3, the connection between the drive mechanism 22 and the strap 34 is internalized within the housing body 18, advantageously removing a potentially dangerous pinch point for an installer.

Figure 4:
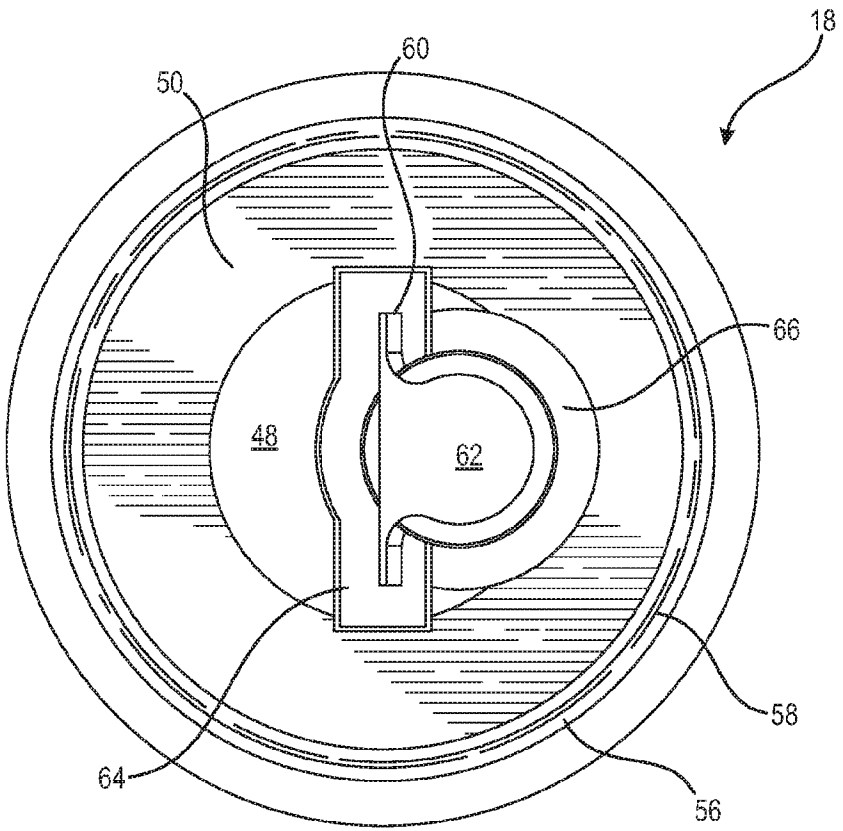
FIG. 4 is a bottom view of the housing body shown in FIG. 1.

Referring to FIGS. 3 and 4, the housing body 18 can define an open cavity 48 having a peripheral internal cavity wall 50. The cavity 48 may have any desired shape, but is shown having a generally conical shape. The housing body 18 can also include a housing top 52 and a housing bottom 54, and the cavity 48 is arranged so that the bottom opening 56 of the cavity 48 is located at or adjacent the housing bottom 54. The cavity 48 includes an upper cavity area adjacent to the housing top and a lower cavity area located towards the housing bottom 54.

The housing body 18 can be formed of a hardened molding material such as an initially liquid or flowable thermoplastic polymer resin or thermosetting plastic material that is injected or which otherwise flows into a mold cavity having a suitable form to create the desired housing body shape when hardened. While the housing body 18 is described comprising thermoplastic polymer resin or a thermosetting plastic material, it will be appreciated that that other suitable materials are possible. For instance, the housing body 18 may comprise a rubber material, a metal material, a composite material, a polymer, a plastic material, a thermoplastic material, a resin, combinations thereof, or any other suitable material.

The lower cavity area can define a circumferential groove 58 at the bottom opening 56. As seen, the groove 58 forms a shoulder or seat that can engage an upper surface of the base plate 20. This has the effect of allowing the base plate 20 to be received within the cavity 48 with the bottom surface of the base plate 20 generally flush with the housing bottom 54.

The outer surface of the housing body 18 can have a generally conical shape or any other ergonomic shape allowing the installer's hand to comfortably cradle the housing body 18. A strap opening 60 extends between the top surface of the housing top 52 and the top wall of the cavity 48. The tensioning member 16 can extend out the cavity 48 through the strap opening 60. A drive opening 62 (also shown in FIG. 1) extends between the top surface of the housing top 52 and the top wall of the cavity 48. The head portion 42 of the drive mechanism 22 extends out of the cavity 48 through the drive opening 62, making it accessible from the outside of the housing body 18.

Optionally, an interior strap structure 64 extends downwardly from the top wall of the cavity 48. The interior strap structure 64 defines a generally rectangular receiving space for receiving and/or supporting the strap 34 within the cavity 48. An interior drive structure 66 also extends downwardly from the top wall of the cavity 48. The interior drive structure 66 defines at least part of a cylindrical receiving space for receiving and/or supporting the drive mechanism 22 within the cavity 48. The interior strap structure 64 can have a length such that the bottom of the interior strap structure 64 engages the upper surface of the base plate 20. The interior drive structure 66 can have a length such that the bottom of the interior drive structure 66 engages the top of a support structure 68 on the base plate 20. This arrangement has the effect of better distributing pressure across the base plate 20.

As best seen in FIG. 4, the drive interior structure 66 can intersect and extend radially beyond the strap interior structure 64. This advantageously provides a space on the opposite side of the strap 34 from the drive mechanism 22 for accommodating the threads 46 extending through the slots 24 in the strap 34.

Figure 5:
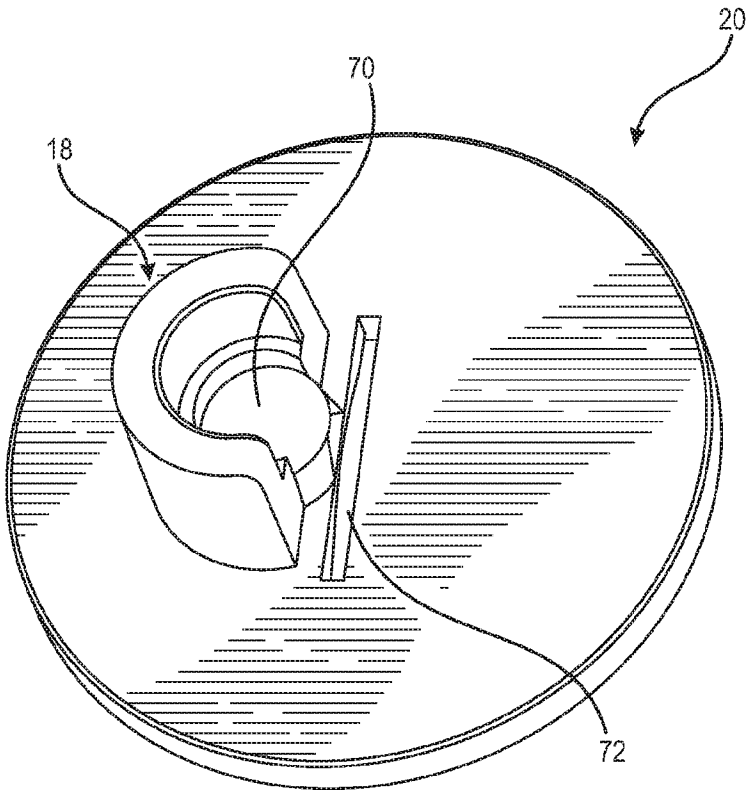
FIG. 5 is a top isometric view of the base plate shown in FIG. 1.

Referring to FIG. 5, the base plate 20 can have a peripheral shape generally corresponding to the groove 58 formed on the housing body 18 or any other suitable shape. The base plate 20 is shown including a generally circular shape. The base plate 20 is arranged to support and distribute pressure from the drive mechanism 22 onto the tiles 26 and to protect the tiles from the drive mechanism 22.

The support structure 68 can protrude upwardly from the top of the base plate 20. The support structure 68 can at least in part define seat 70 for receiving and supporting the distal end of the drive mechanism 22. The distal end of the drive mechanism 22 is arranged to rotate within the seat of the support structure 68. A second strap slot 72 is defined in the base plate 20. The second strap slot 72 is positionable below the strap slot 60 so that the strap 34 can extend through the loading system 12 directly between the two strap slots. The bottom surface of the base plate 20 is arranged to face and engage the top of the tiles 26.

In use, the loading system 12 can be pre-loaded on the strap 34 and the anchor member 14 can be positioned in the setting bed beneath the tiles 26 so that the strap 34 extends upwardly between adjacent tiles 26 (e.g., joint or corner locations) and the loading system 12 is positioned above the tiles. In an embodiment, the strap 34 and base plate 20 can be manufactured and assembled as a single assembly or unit so that there is no assembly of these components at the jobsite before installation.

The installer can then grip the housing body 18 and rotate the drive mechanism 22 in a first direction to move the housing body 18 and base plate 20 along the strap 34 toward the tiles 26 until the tiles 26 are in contact with the base plate 20 and the anchor member 14 as shown in FIG. 2.

Once the tiles 26 are secured between the base plate 20 and anchor member 14, the installer can continue to rotate the drive mechanism 22 in the first direction to further tension the strap 34, which, in turn, forces the anchor member 14 and base plate 20 together until the tiles 26 are level and aligned with one another between the anchor member 14 and the base plate 20. This advantageously reduces the likelihood of lippage and reduces the need to re-lift tiles to add more setting material and level the tiles and/or the process of shimming the tiles, which, in turn, greatly increases the speed of installation.

It should be appreciated that in this embodiment the drive mechanism 22 is rotated relative to the housing body 18 and base plate 20. The housing body 18 and base plate 20 are not required to be rotated on the top surface of the tiles 26 to actuate the system 10 as in the prior art. This is advantageous because rotation of the housing body 18 and/or base plate 20 on the top surface of the tiles 26 may in some instances entrap debris including sand from setting mortar, which has the potential to scratch the tiles 26, especially softer marble tiles with highly polished surfaces. Further, because the strap 34 interacts with the helical threads 46 of the drive mechanism 22 as compared to discrete and/or incremental teeth, the system 10 allows for more sensitive adjustments of the height of the tiles 26 when the installer rotates the drive mechanism 22.

The system 10 can then be left in place so that the corners and/or edges of the adjacent tiles 26 remain aligned and level as the setting bed hardens, eliminating the need for the installer to continually monitor and go back and adjust tiles as the tiles are observed settling out of alignment as a tile installation process progresses. This process can be repeated upon setting the next tile or tiles in place.

After a desired number of tiles are placed and the setting bed has cured (securing the tiles 26 to the substrate), the installer can remove the loading system 12 and the strap 34 from the system 10. For instance, the installer can further rotate the drive mechanism 22 in the first direction, increasing the tension in the strap 34 as the drive mechanism 22 pulls the strap 34 away from the anchor member 14 under the tiles 26. This can be done until the tension in the strap 34 reaches a breaking tension, separating the strap 34 at the breakage point 36, leaving the anchor member 14 in place. Because the strap 34 is made of a metallic material as compared to a plastic material, the likelihood of a clean break at the breakage point 36 is increased. The system 10 can thus ensure proper leveling of tiles and speed up the leveling process without compromising the overall aesthetics of the tile job.

In an embodiment, the strap 34 can then be simply pulled up and out of the housing body 18. This is beneficial because many leveling devices require manual untwisting by hand for disassembly, which can be both fatiguing and daunting on installation jobs involving hundreds of leveling devices.

Figure 6:
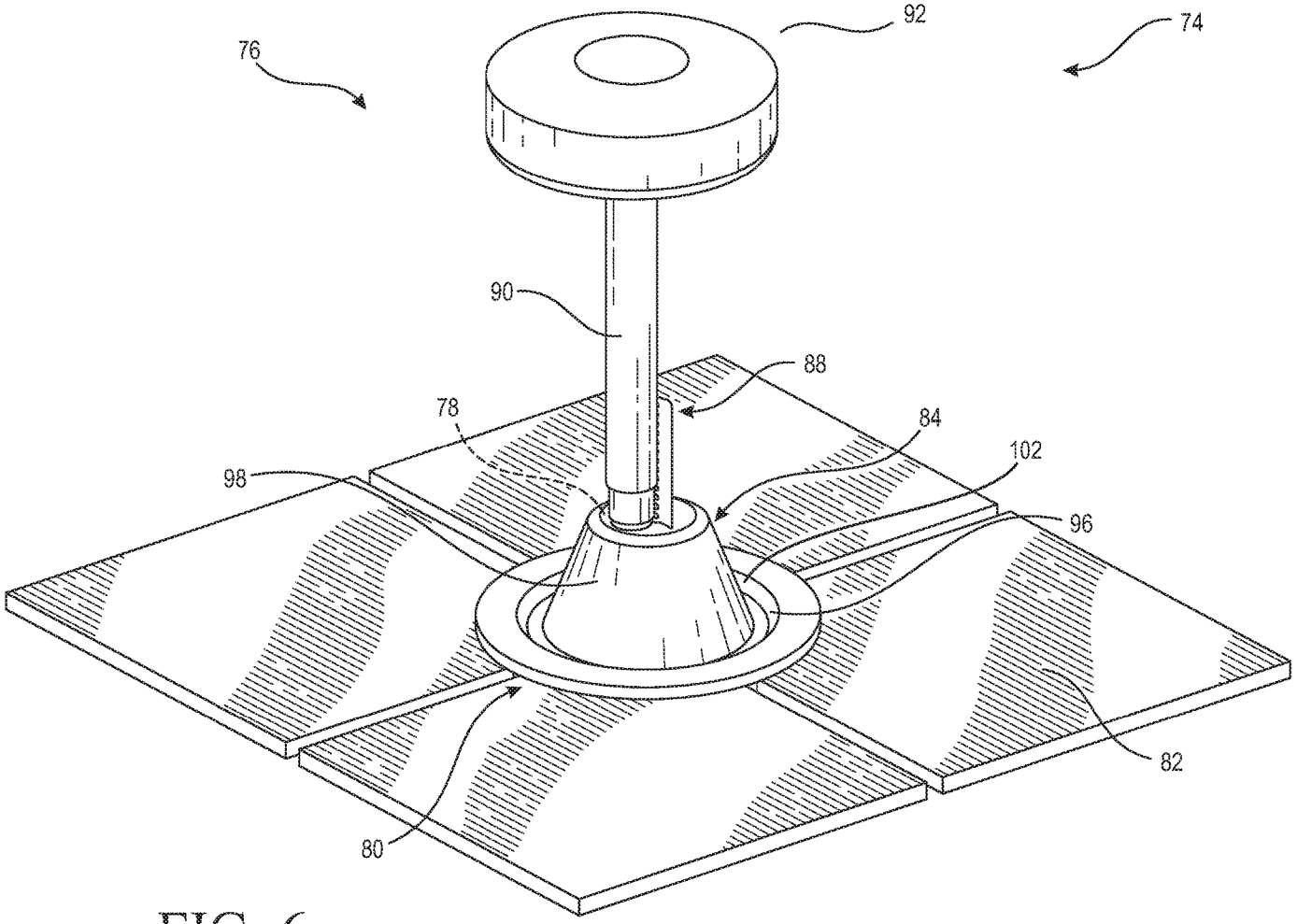
FIG. 6 is a top isometric view of a tile leveling system according to another embodiment.

A second exemplary embodiment of a tile leveling system 74 is shown in FIGS. 6 and 7. The system 74 can be similar to the system 10 except that a rotating hand tool 76 is connectable to the drive mechanism 78. The system 74 further includes a separate spacer member 80 for defining a joint width between tiles 82. Like the system 10, the system 74 includes a loading system 84, an anchor member 86, and a tensioning member 88 extending upwardly form the anchor member 86 and operatively connected to the loading system 84.

As seen, the hand tool 76 can include a shaft portion 90 including a distal end portion defining a receptacle for receiving a head portion of the drive mechanism 78 and a proximal end portion having a grip portion 92. The grip portion 92 can comprise an enlarged portion having a cylindrical or other ergonomic shape that allows an installer to easily grip the hand tool 76, facilitating manual rotation of the drive mechanism 78 by the installer. Also seen in FIGS. 6 and 7, the anchor member 86 can be positioned in the setting bed beneath four tiles 82 so that the tensioning member 88 extends from the anchor member 86 upwardly between the adjacent tiles 82 at the corner locations.

The spacer member 80 is arranged to allow the system 74 to be used for a wide variety of grout joint widths independent of the width of the tensioning member 88. For instance, the joint width between the tiles 82 can be defined by spacing protrusions 94 formed on the spacer member 80. More particularly, the spacer member 80 has an upper surface and a lower surface formed with radial running spacing protrusions 94 for defining the joint width between the tiles 82. The spacing protrusions 94 can extend radially beyond the main body of the spacer member 80 for visibility. This is beneficial so that the installer can observe that each spacing protrusion 94 is in contact with the tile 82 on opposites of the joint or grout joint, helping to ensure proper alignment.

The spacer member 80 has a ring configuration, having a center opening 96 in which the loading system 84 may be positioned. The diameter of the center opening 96 can be greater than the outer diameter of the housing body 98 such that a gap is present between the housing body 98 and the spacer member 80. This gap can be sized to allow an installer to see into the joints adjacent to the housing body 98. Optionally, the center opening 96 can include a beveled top edge 102, increasing the viewing angle into the joints. The diameter of the center opening 96 can also be selected to locate the spacing protrusions 94 a further distance from a center of the system 80, helping to prevent the tiles from tilting or rocking in response to pressures applied to the tiles by the anchor member and the loading system.

As seen best in FIG. 7, the spacer member 80 can have four spacing protrusions 94 for defining the joint width between the tiles 82. More particularly, each tile corner occupies one of the four equally sized quadrants of the spacer member 80. The spacing protrusions 94 perform their function of spacing the four tiles apart from one another in an aligned configuration because the spacing protrusions 94 are straight and are disposed in normal relation to one another or are in an X-configuration. In other embodiments, the spacer member 80 can include two spacing protrusions arranged to fit straight joints (e.g., two spacing protrusions in line). In yet other embodiments, the spacer member 80 can include three or more spacing protrusions arranged in a T-configuration for use with staggered joints. It will be appreciated that the spacing protrusions 94 can be produced in different widths in order to form gaps or joints of the desired width. In other embodiments, the system 74 can include a plurality of spacer members, each including spacing protrusions of different widths such that the system 74 can set different joint widths for different tile jobs.

In use, the spacer member 80 is inserted over and around the housing body 98. As such, it is totally inserted from the top and is removable from the top after the setting bed has cured before grouting. This is advantageous because many tile jobs involve the user of extremely thin large format porcelain tiles having a thickness as small as about ⅛ inch (or 3 mm). With tile this thin, it is impractical to hide permanent tile spacers within the grout joint. Moreover, cementitous grouts do have the bond strength to cover and hide such permanent spacers as grouts must be installed with sufficient sectional dimension to resist forces that would cause them to pop out of the grout line. Specifically, cementitous grouts do not bond to polymer tile spacers, causing them to fail to remain in place wherever applied over. Thus, because the spacer member 80 is insertable and removable from the top before grouting, the spacer member 80 can be used with a wider variety of tile thicknesses as compared to permanent tile spacers found in the prior art.

Moreover, the reusable spacer member 80 can offer to the user hundreds of cycles of use over its lifetime, making it more economical.

Figure 8:
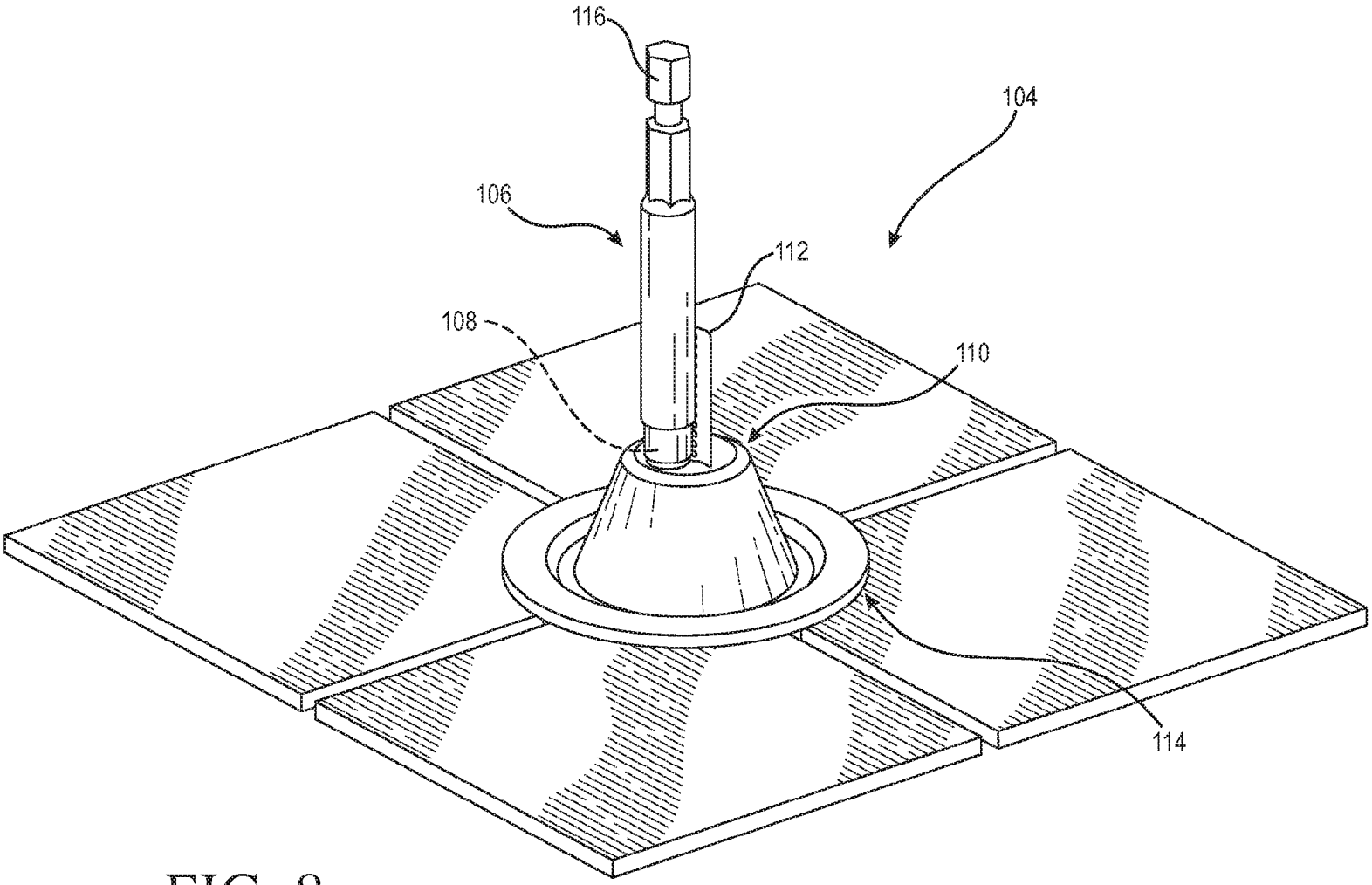
FIG. 8 is a top isometric view of a tile leveling system according to another embodiment.

A third exemplary embodiment of a tile leveling system 104 is shown in FIG. 8. The system 104 can be similar to the systems 10 and 74 except that a driver system 106 is operatively connected to the drive mechanism 108. Similar to the other systems, the system 104 includes a loading system 110, an anchor member, a tensioning member 112 extending upwardly from the anchor member and operatively connected to the loading system 110, and a spacer member 114.

The driver system 106 can include a distal portion defining a receptacle for receiving a head portion of the drive mechanism 108 and a proximal portion including a post section 116 as shown. The post section 116 may have a length suitable for allowing the post section 116 to fit into a drill on one end. The post section 116 may have a cross-sectional shape arranged to fit into a drill chuck (not shown). In some embodiments, the cross-sectional shape of the post 116 may be hexagonal.

The post section 116 may be made of a material strong and rigid enough to allow a drill (not shown) to turn the driver system 106 via the post section 116. The post 116 may be made of steel, hardened steel, bronze, or any other suitable material. This advantageously allows an installer to tension the tensioning member 112 with a power drill (e.g. a cordless drill), substantially decreasing the time required to remove the system from a tiled floor after use. Moreover, with hundreds of leveling devices often required to do a single tile installation job, the ability of the system 104 to be tensioned with the drill as opposed to manual manipulation of each device eliminates a substantial amount of repetitive hand motion for the installer, which can be both fatiguing and daunting.

The drills are also commonly available with torque adjusting clutches, providing more precise control of tension within the system through the use of a torque setting on the drill. Moreover, the devices or systems 104 can also be removed with the same drill set at a higher torque setting, making removal of tensioning member 112 and loading system 110 possible with a reduced amount of repetitive hand motion. For instance, with one pull of the drill's trigger, the tensioning member 112 can be separated at its breakage point and removed from the loading system 110.

Further, because the tensioning system 112 is made of a metallic material, the tensioning system 112 is more likely to make a clean break from the anchor member.

It will be appreciated that the tile leveling system embodiments are to be regarded as exemplary only, as any tile leveling system is possible. For instance, the housing body is not listed to a conical member but can exhibit any suitable configuration. In other embodiments, the strap can comprise a plastic material, a composited material, combinations thereof, or any other suitable material. While the drive mechanism is described as a threaded cylindrical member, the drive mechanism can comprise any suitable drive mechanism. In other embodiments, the base plate may engage the tiles and the housing and drive mechanism may be rotated to actuate the system.

While various aspects and embodiments have been disclosed herein, other aspects and embodiments are contemplated. The various aspects and embodiments disclosed herein are for purposes of illustration and are not intended to be limiting. Additionally, the words "including," "having," and variants thereof (e.g., "includes" and "has") as used herein, including the claims, shall be open ended and have the same meaning as the word "comprising" and variants thereof (e.g., "comprise" and "comprises").

The invention claimed is:

1. A tile leveling system comprising:

an anchor member arranged to be positioned in a setting bed below adjacent tiles;

a tensioning member extending upwardly from the anchor member and arranged to pass between the adjacent tiles, the tensioning member comprised of a metallic material and frangibly connected to the anchor member via a breakage point; and a loading system positionable on top of the adjacent tiles, the loading system including a base plate, a housing body arranged to engage an upper surface of the base plate and defining an opening cavity, and a drive mechanism comprising a worm supported by the base plate and rotatably connected to the tensioning member inside the cavity via a plurality of slots defined in the tensioning member, the worm selectively operable to secure and level the adjacent tiles between the anchor member and the base plate.

2. The system of claim 1, wherein the base plate exerts a compressive pressure on the top of the adjacent tiles to secure and level the tiles between the base plate and the anchor member.

3. The system of claim 2, wherein the housing body defines a circumferential groove at a bottom opening of the housing body and the base plate is positioned in the circumferential groove.

4. The system of claim 2, wherein the tensioning member is arranged to pass through an opening defined in the base plate.

5. The system of claim 1, wherein the drive mechanism defines a plurality of threads and the tensioning member comprises a strap defining the slots arranged to mesh with the threads of the drive mechanism.

6. The system of claim 5, wherein the threads have a greater hardness than the tensioning member.

7. The system of claim 1, wherein rotation of the drive mechanism in a first direction tensions the tensioning member to level and align the adjacent tiles.

8. The system of claim 1, wherein rotation of the drive mechanism in a first direction tensions the tensioning member to selectively break and separate from the anchor member at the breakage point.

9. The system of claim 1, wherein the breakage point is located below the top of the adjacent tiles and comprises a single connecting portion extending between the tensioning member and connection between the tensioning member and the anchor member.

10. The system of claim 1, further comprising a power drill arranged to drive rotation of the drive mechanism.

11. The system of claim 1, further comprising a rotating hand tool arranged to drive rotation of the drive mechanism.

12. The system of claim 1, further comprising a spacer member having an upper surface and a lower surface formed with radial running spacing protrusions for defining a joint width between the adjacent tiles, the spacer member being insertable over and around the loading system.

13. The system of claim 12, wherein the spacer member has a ring configuration defining a center opening.

14. The system of claim 13, wherein the center opening has a diameter greater than an outer diameter of a housing body of the loading system.

15. A tile leveling system comprising:

an anchor member arranged to be positioned in a setting bed below adjacent tiles;

a tensioning member extending upwardly from the anchor member and arranged to pass between the adjacent tiles, the tensioning member comprised of a metallic material and frangibly connected to the anchor member via a breakage point; and a loading system operatively connected to the tensioning member and positionable on top of the adjacent tiles, the loading system including a base plate, a housing body arranged to engage an upper surface of the base plate and defining an open cavity, and a drive mechanism comprising a worm supported by the base plate and operatively connected to the tensioning member inside the cavity via a plurality of slots defined in the tensioning member, the worm selectively rotatable relative to the housing body to tension the tensioning member and level the adjacent tiles between the anchor member and the base plate.

16. The system of claim 15, wherein rotation of the drive mechanism in a first direction tensions the tensioning member to level and align the adjacent tiles.

17. The system of claim 15, wherein rotation of the drive mechanism in a first direction tensions the tensioning member to selectively break and separate the tension member at the breakage point.

18. The system of claim 15, wherein the housing body has a conical configuration and the connection between the drive mechanism and the tensioning member is internalized within the housing body.

19. A tile leveling system comprising:

an anchor member arranged to be positioned in a setting bed below adjacent tiles;

a tensioning member extending upwardly from the anchor member and arranged to pass between the adjacent tiles, the tensioning member comprised of a metallic material and frangibly connected to the anchor member via a breakage point;

a housing body positioned on the tensioning member;

a base plate separate from the housing body and located at or near a bottom of the housing body, the base plate arranged to be positioned on top of the adjacent tiles; and a drive mechanism comprising a worm supported by the base plate and rotatably connected to the tensioning member inside the housing body via a plurality of slots defined in the tensioning member, the drive mechanism selectively rotatable relative to the housing body to tension the tensioning member and secure the adjacent tiles between the anchor member and the base plate.

* * * * *